US008205539B2

(12) United States Patent
Kisse et al.

(10) Patent No.: US 8,205,539 B2
(45) Date of Patent: Jun. 26, 2012

(54) TWO BOLT ADJUSTABLE CENTERING SYSTEM

(75) Inventors: Brandon J. Kisse, Kindred, ND (US); Mark R. Murphy, Gwinner, ND (US)

(73) Assignee: Clark Equipment Company, West Fargo, ND (US)

( * ) Notice: Subject to any disclaimer, the term of this patent is extended or adjusted under 35 U.S.C. 154(b) by 786 days.

(21) Appl. No.: 12/439,558

(22) PCT Filed: Aug. 30, 2007

(86) PCT No.: PCT/US2007/077182
§ 371 (c)(1),
(2), (4) Date: Mar. 2, 2009

(87) PCT Pub. No.: WO2008/028007
PCT Pub. Date: Mar. 6, 2008

(65) Prior Publication Data

US 2010/0021325 A1 Jan. 28, 2010

Related U.S. Application Data

(60) Provisional application No. 60/824,300, filed on Sep. 1, 2006.

(51) Int. Cl.
*F04B 9/02* (2006.01)
*F16H 61/40* (2010.01)

(52) U.S. Cl. ..... 92/12.2; 60/487

(58) Field of Classification Search ..... 60/487; 92/12.2
See application file for complete search history.

(56) References Cited

U.S. PATENT DOCUMENTS 4,064,766 A 12/1977 Rinaldo
4,093,953 A 6/1978 Hammons et al.
(Continued)

OTHER PUBLICATIONS

Search Report and Written Opinion dated Jun. 10, 2008 for International application No. PCT/US2007/077182, filed Aug. 30, 2007.

(Continued)

*Primary Examiner* — Thomas E Lazo
(74) *Attorney, Agent, or Firm* — Leanne Taveggia Farrell; Westman, Champlin & Kelly, P.A.

(57) ABSTRACT

A centering mechanism for a hydraulic pump, a hydraulic pump assembly and a method of assembling a hydraulic pump assembly. The pump assembly generally includes a hydraulic pump, a control arm, and a centering mechanism. The pump generally includes a pump housing, a pump mechanism operable to control a flow of hydraulic fluid through the housing, the pump mechanism having a neutral condition in which fluid does not flow through the housing, a trunnion cap connectable to the housing, the trunnion cap and the housing cooperating to house the pump mechanism, and an input shaft extending along an axis and through the trunnion cap, the shaft being rotatable to operate the pump mechanism. The control arm is connected to the shaft, and movement of the control arm causes rotation of the shaft. The centering mechanism may generally include a first bracket fixable to the housing, a second bracket adjustably fixable to the first bracket, and biasing structure operable to return the control arm to a centered position when an operating force is not applied to the control arm. The second bracket is adjustable relative to the first bracket to an adjusted position such that the centered position corresponds to the neutral condition of the pump mechanism, the second bracket being fixable in the adjusted position. Fasteners fix the first bracket and the trunnion cap to the pump housing.

20 Claims, 14 Drawing Sheets

U.S. PATENT DOCUMENTS

| | | | | |
|---|---|---|---|---|
| 4,111,062 | A | 9/1978 | Callaghan | |
| 4,934,252 | A | 6/1990 | Giere | |
| 4,955,249 | A | 9/1990 | Wetor | |
| 5,044,478 | A | 9/1991 | Kaesgen et al. | |
| 5,241,872 | A | 9/1993 | Betz et al. | |
| 5,836,159 | A | 11/1998 | Shimizu et al. | |
| 6,109,032 | A | 8/2000 | Shimizu et al. | |
| 6,487,857 | B1 | 12/2002 | Poplawski et al. | |
| 6,715,283 | B2 | 4/2004 | Abend et al. | |
| 6,715,285 | B2 | 4/2004 | Isaac, Jr. | |
| 6,782,797 | B1 * | 8/2004 | Brandenburg et al. | 92/12.2 |
| 6,968,687 | B1 | 11/2005 | Poplawski et al. | |
| 7,032,377 | B1 | 4/2006 | Keller et al. | |
| 7,051,641 | B2 | 5/2006 | Berg et al. | |

OTHER PUBLICATIONS

Office Action dated Mar. 26, 2010 for Chinese Patent Application No. 200780032623.5, based on PCT/US2007/077182.

Canadian Patent Application No. 2,661,854 Examiner's Report dated Jun. 14, 2010.

* cited by examiner

TWO BOLT ADJUSTABLE CENTERING SYSTEM

CROSS-REFERENCE TO RELATED APPLICATIONS

This Application is a Section 371 National Stage Application of International Application No. PCT/US2007/077182, filed Aug. 30, 2007 and published as WO 2008/028007 A2 on Mar. 6, 2008, which claims priority to U.S. Provisional Patent Application Serial No. 60/824,300, filed Sep. 1, 2006, the entire contents of which is hereby incorporated by reference.

FIELD OF THE DISCLOSURE

This disclosure is related to power machines. More particularly, this disclosure is related to power machines having a hydraulic drive system.

SUMMARY

Power machines can utilize a hydraulic system (sometimes known as a hydrostatic system) to supply power to drive the power machine. For example, a conventional skid steer loader has a hydraulic pump that provides hydraulic oil to a hydraulic drive motor causing the hydraulic drive motor to be actuated. The hydraulic drive motor has an output that is transmitted to one or more axles to drive wheels that cause the power machine to move. One type of power machine, a skid steer loader, has a pair of hydraulic pumps, one for each side of the machine, to provide drive power to each side of the machine independently.

The conventional hydraulic pump of the type implemented in a power machine has an input or pintle shaft that extends from a pump housing and is coupled to an internal mechanism such as a swash plate located within the pump housing. The input shaft is actuable to cause the internal mechanism or swash plate to move within the hydraulic pump. The swash plate has a neutral or center position. When the swash plate is in the neutral position, the hydraulic pump is not providing any hydraulic oil to the hydraulic motor.

An operator has access to drive control actuators that are operably coupled to the input shafts of the hydraulic pumps. When the operator engages the drive control actuator, the input shaft of the hydraulic motor is actuated, causing the internal mechanism or swash plate to move from the neutral position, thereby allowing the hydraulic oil to be pumped out of the hydraulic pump to the hydraulic motor. When the drive control actuators are not engaged, the input shaft is urged to the neutral position by a pump centering mechanism that engages the input shaft.

Pump centering mechanisms can be adjusted to ensure that the input shaft returns to the neutral position, as opposed to returning to a position that is slightly off of the neutral position. In such a case, the power machine may creep in a forward or reverse direction when the operator is not engaging the drive control actuators. Adjustments to the pump centering mechanism may be relatively small and can be difficult to make.

Because it may be necessary to adjust the pump centering mechanism, what is needed is a pump centering mechanism that is easy to adjust. Such a mechanism should be easy to access when the hydraulic pump has been installed within the power machine and should be capable of accepting minor adjustments in a consistent manner.

In some independent aspects, the invention provides a centering mechanism for a hydraulic pump. The pump generally includes a pump housing and an input shaft extending along an axis, the pump having a neutral condition in which hydraulic fluid does not flow through the pump, a control arm being connected to the shaft, movement of the control arm controlling operation of the pump. The centering mechanism may generally include a bracket assembly and biasing structure operable to return the control arm to a centered position when an operating force is not applied to the control arm. The bracket assembly may include a first bracket fixable to the housing and defining threaded holes, a second bracket adjustably fixable to the first bracket member, the second bracket defining slots associated and partially alignable with the threaded holes, and adjusting fasteners, each adjusting fastener extending through an associated slot and threadable in an associated threaded hole to adjustably fix the second bracket to the first bracket. The second bracket is adjustable relative to the first bracket such that the centered position corresponds to the neutral condition of the pump, the second bracket being fixable in the position by the adjusting fasteners.

In some independent aspects, the invention provides a hydraulic pump assembly. The pump assembly generally includes a hydraulic pump, a control arm, and a centering mechanism. The pump generally includes a pump housing, a pump mechanism operable to control a flow of hydraulic fluid through the housing, the pump mechanism having a neutral condition in which fluid does not flow through the housing, a trunnion cap connectable to the housing, the trunnion cap and the housing cooperating to house the pump mechanism, and an input shaft extending along an axis and through the trunnion cap, the shaft being rotatable to operate the pump mechanism. The control arm is connected to the shaft, and movement of the control arm causes rotation of the shaft.

In such aspects, the centering mechanism may generally include a first bracket fixable to the housing, a second bracket adjustably fixable to the first bracket, and biasing structure operable to return the control arm to a centered position when an operating force is not applied to the control arm. The second bracket is adjustable relative to the first bracket to an adjusted position such that the centered position corresponds to the neutral condition of the pump mechanism, the second bracket being fixable in the adjusted position. Fasteners fix the first bracket and the trunnion cap to the pump housing.

In some independent aspects, the invention provides a method of assembling a hydraulic pump assembly. The pump assembly generally includes a hydraulic pump, a control arm, and a centering mechanism. The pump includes a pump housing, a pump mechanism operable to control a flow of hydraulic fluid through the housing, the pump mechanism having a neutral condition in which fluid does not flow through the housing, a trunnion cap, and an input shaft extending along an axis, the shaft being rotatable to operate the pump mechanism. Movement of the control arm causes rotation of the shaft. The centering mechanism generally includes a first bracket, a second bracket, and biasing structure operable to return the control arm to a centered position when an operating force is not applied to the control arm.

In such aspects, the method may generally include the acts of positioning the pump mechanism at least partially in the housing; positioning the trunnion cap on the housing to substantially enclose the pump mechanism; providing fixing fasteners; with the fixing fasteners, fixing the first bracket and the trunnion cap to the housing, the shaft extending through the trunnion cap; providing adjusting fasteners; with the adjusting fasteners, connecting the first bracket and the second bracket; connecting the control arm to the shaft; loosening the adjusting fasteners to unfix the second bracket from the first bracket; moving the second bracket relative to the first bracket to an adjusted position such that the centered position corresponds to the neutral condition of the pump; and tightening the adjusting fasteners to thereby fix the second bracket to the first bracket in the adjusted position.

Figure 1:
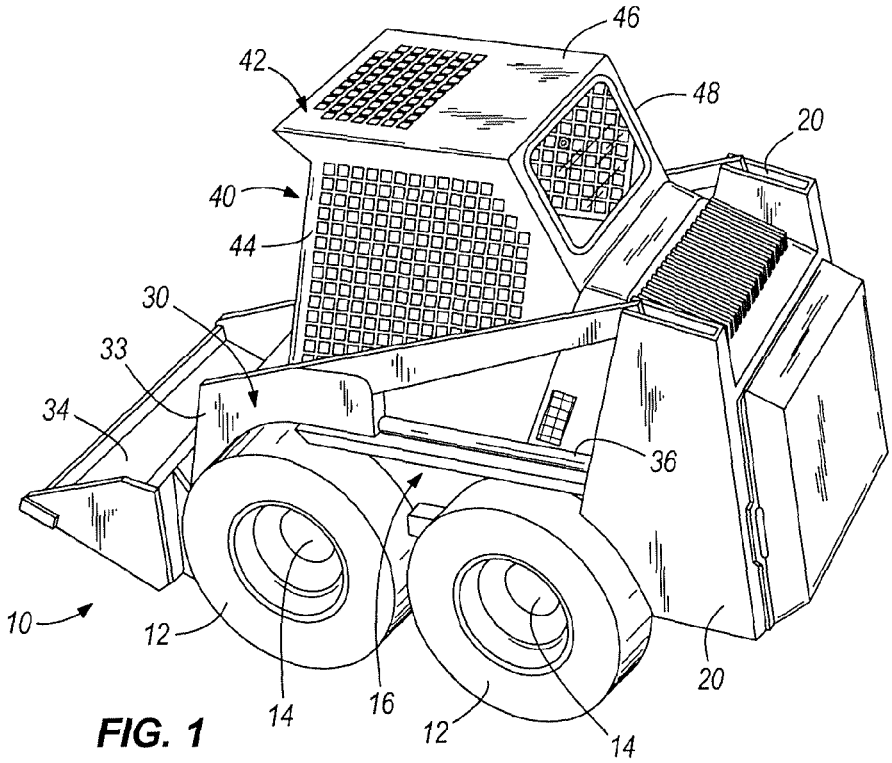
FIG. 1 is a perspective view of a power machine of the type in which the present disclosure may be implemented illustrating a side and rear view of the power machine.

Before any features and at least one embodiment of the invention are explained in detail, it is to be understood that the invention is not limited in its application to the details of construction and the arrangements of the components set forth in the following description and claims or illustrated in the drawings. The invention is capable of other embodiments and of being practiced or being carried out in various ways. Also, it is understood that the phraseology and terminology used herein is for the purpose of description and should not be regarded as limiting.

The use of "including", "having", and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 2:
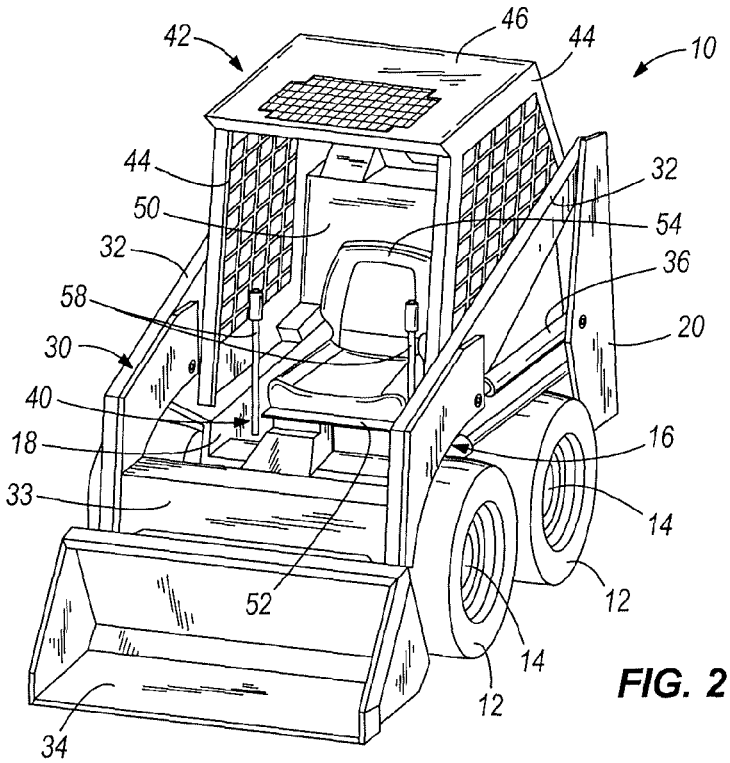
FIG. 2 is a perspective view of the power machine of FIG. 1 illustrating a front and side view of the power machine.

A power machine 10, of the type in which incorporation of the present disclosure is useful, is illustrated generally in FIGS. 1 and 2. As shown, power machine 10 includes a main frame assembly 16, lift arm assembly 30 and operator compartment 40. A pair of wheels 12, which are mounted to stub axles 14, extend from both sides of main frame 16.

Lift arm assembly 30 is mounted to upright members 20 of main frame assembly 16. As shown, lift arm assembly 30 includes a pair of lift arms 32, which overlie wheels 12. Lift arms 32 are attached to each other by a cross member 33, and are pivotally mounted at a rearward end to upright members 20. Lift arm assembly 30 is configured to be pivotally attached to an attachment such as bucket 34. Lift arm assembly 30 is raised and lowered with respect to main frame assembly 16 by actuating a pair of lift cylinders 36. Each of the lift cylinders 36 has a first end pivotally mounted to one of upright members 20 and a second end pivotally mounted to one of lift arms 32. Bucket 34 is rotated with respect to lift arms 32 in a known manner by actuating one or more bucket tilt cylinders (not shown).

Operator compartment 40 is defined and partially enclosed by a cab 42. Cab 42 includes side panels 44, overhead panel 46, rear panel 48, and seat pan 52 upon which seat 54 is mounted. Cab 42 is an integral unit and is pivotally mounted at its rear to main frame assembly 16. Cab 42 is positioned above an engine compartment (not shown) that is located within the main frame assembly 16. Drive control actuators 58, which, in the illustrated embodiment are pivotable levers, are positioned within the operator compartment 40. By manipulating each of the drive control actuators 58, such as by moving them in a forward or rearward direction, the operator can control a hydraulic drive system, located in the engine compartment and described in more detail below. The hydraulic drive system causes the power machine 10 to move in a forward or reverse direction.

In the illustrative embodiment, shown in FIGS. 1 and 2, power machine 10 is a skid steer loader, and an operator uses drive control actuators 58 to control both the movement and the steering of the power machine 10. Power machine 10 is not limited by any particular feature of the skid steer loader shown in FIGS. 1 and 2. As one example, the drive control actuators 58 need not be pivotable levers but can be any type of actuation device. In addition, power machine 10 can be any type of vehicle that incorporates a hydraulic drive system, such as a mini excavator, a wheeled loader, a utility vehicle, to name a few non-limiting examples.

Figure 3:
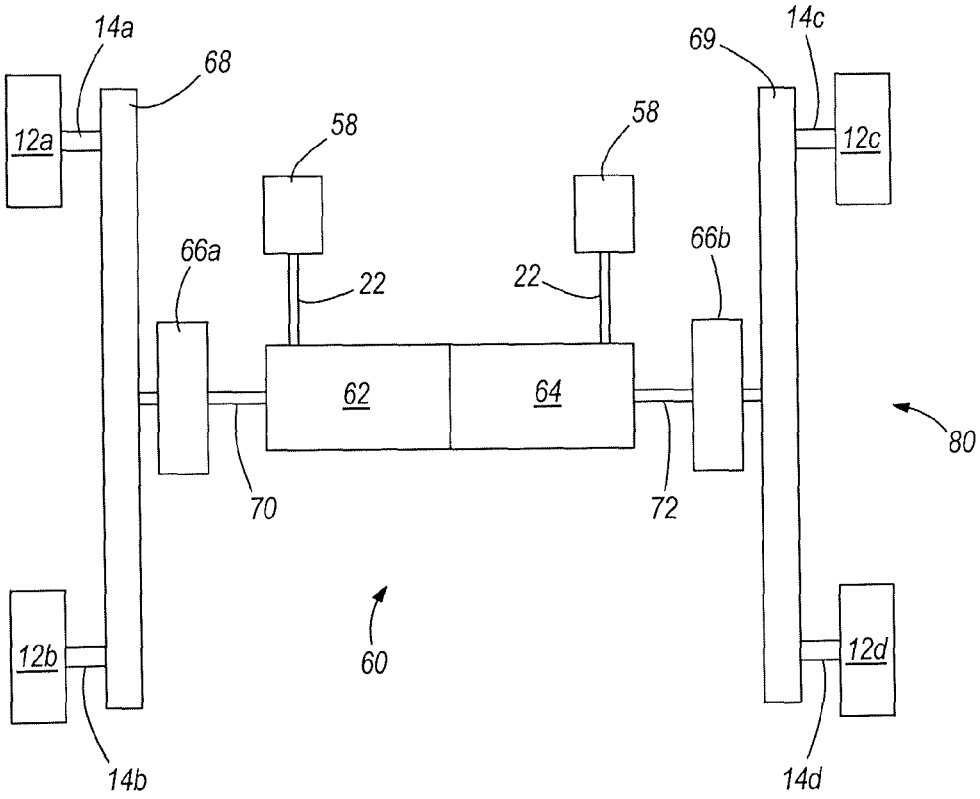
FIG. 3 is a block diagram illustrating a hydraulic drive system of the type implemented in the power machine of FIG. 1.

FIG. 3 is a block diagram illustrating a hydraulic drive system 80 suitable for use in power machine 10. Hydraulic drive system 80 includes a hydraulic pump assembly 60, which, in the illustrative embodiment, includes a left drive pump 62 and a right drive pump 64. For the purposes of this disclosure, the left drive pump 62 powers the drive on the left hand side of the power machine 10, and the right drive pump 64 powers the drive on the right hand side of the power machine 10. A drive control actuator 58, located in the operator compartment 40 (shown in FIG. 2), is coupled to each of the left drive pump 62 and the right drive pump 64 via links 22. Links 22, in the illustrated embodiment, include a rigid link operably coupled to both the drive control actuator 58 and one of the left and right drive pumps 62 and 64. Actuation of one of the drive control actuators 58 in a forward or reverse direction is communicated via one of the links 22 to left drive pump 62 or to right drive pump 64.

When the left drive pump 62 has been actuated by its corresponding drive control actuator 58, the left drive pump 62 pumps hydraulic oil into the hydraulic motor 66A via a hydraulic link 70 such as a hose. Hydraulic motor 66A is operatively coupled to a transfer mechanism 68, which in turn is coupled to a pair of axles 14A and 14B. Oil flow into the hydraulic motor 66A causes the hydraulic motor 66A to provide a rotational force to the transfer mechanism 68. Transfer mechanism 68, in turn, causes the axles 14A and 14B to rotate in a forward or reverse direction depending upon the direction of the oil flow into the hydraulic motor 66A. Axles 14A and 14B are coupled to wheels 12A and 12B, which turn with the axles 14A and 14B to cause the power machine 10 to move.

Transfer mechanism 68 can be any suitable structure capable of transmitting an output of the hydraulic motor 66A to the axles 14A and 14B. For example, the transfer mechanism 68 can include an assembly of gears and chains configured to operably couple both of the axles 14A and 124B to the output of hydraulic motor 66A to drive the axles 14A and 14B in tandem. Alternatively, any other structure can be provided to transfer the output of the hydraulic motor 66A to either axle 14A or axle 14B, or both.

Similarly, the right drive pump 64 is coupled to a hydraulic motor 66B via a hydraulic link 72. Hydraulic motor 66B has an output that is coupled to a transfer mechanism 69. Transfer mechanism 69, in turn, is coupled to axles 14C and 14D. Axles 14C and 14D are coupled to wheels 12C and 12D. Thus, actuation of the drive control actuator 58 in communication with right drive pump 64 causes oil to be pumped, via hydraulic link 72, into hydraulic motor 66B. Depending on the direction of oil pumped into hydraulic motor 66B, the wheels 12C and 12D will be driven in a forward or reverse direction. Transfer mechanism 69 can also be any suitable structure capable of transmitting an output of the hydraulic motor 66B to the axles 14C and 14D.

The drive system 80 illustrated in FIG. 3 is shown for illustrative purposes only. Other drive systems may be incorporated into power machine 10. For example, power machine 10 can include a hydraulic motor dedicated to each of the wheels on the machine. Thus, each wheel can be independently driven by one of the left and right drive pumps. Similarly, the hydraulic pump assembly can have a single hydraulic drive pump that controls either the front two or rear two wheels for a two-wheel drive power machine 10. Alternatively still, the front wheels and rear wheels can each be driven together by a hydraulic pump assembly having a single hydraulic drive pump or tandem hydraulic drive pumps to provide four-wheel drive.

Figure 4:
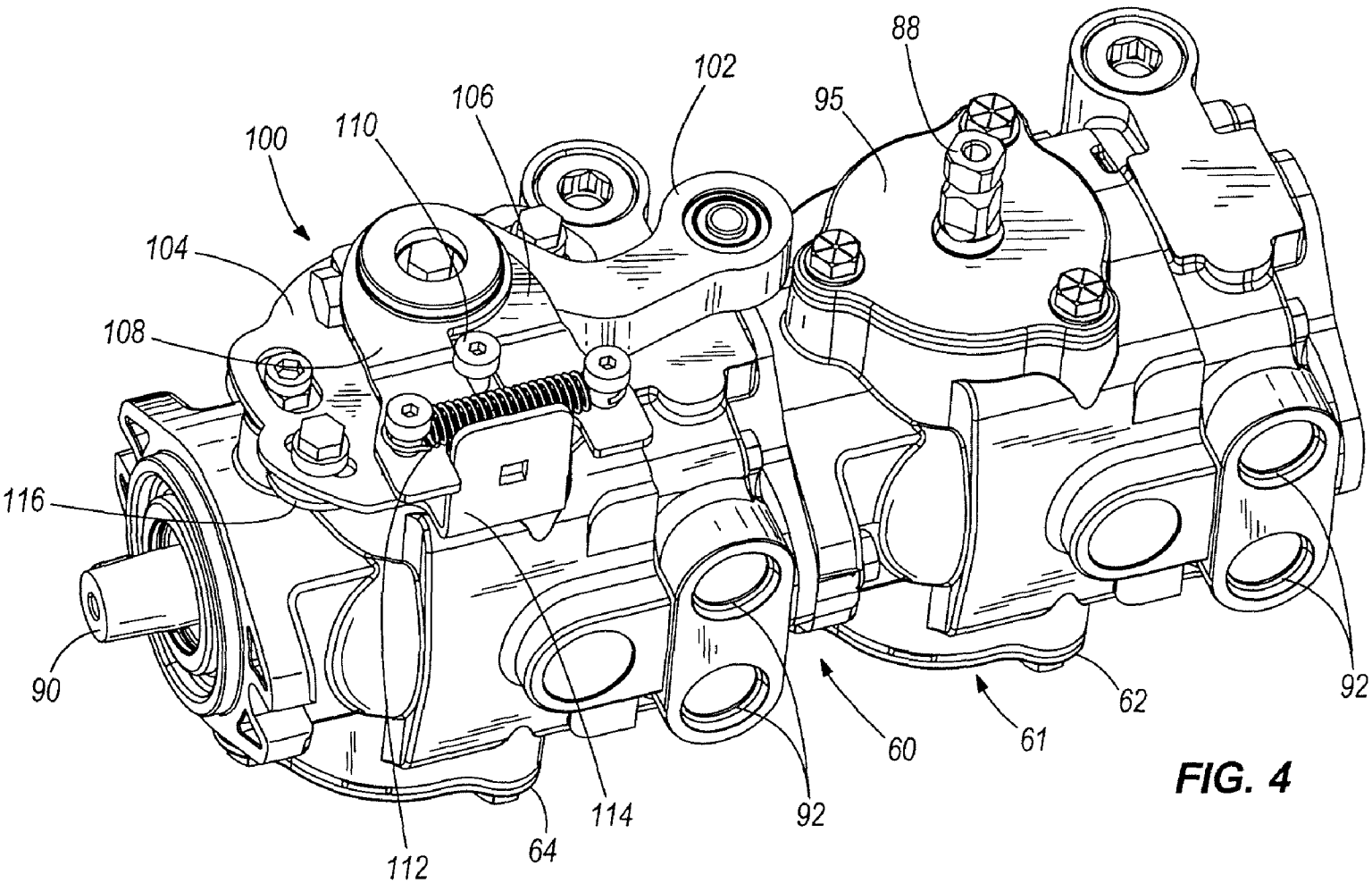
FIG. 4 is a perspective view of a tandem hydraulic pump assembly illustrating a centering mechanism of one illustrative embodiment coupled to an input shaft of one of the hydraulic pumps.
Figure 5:
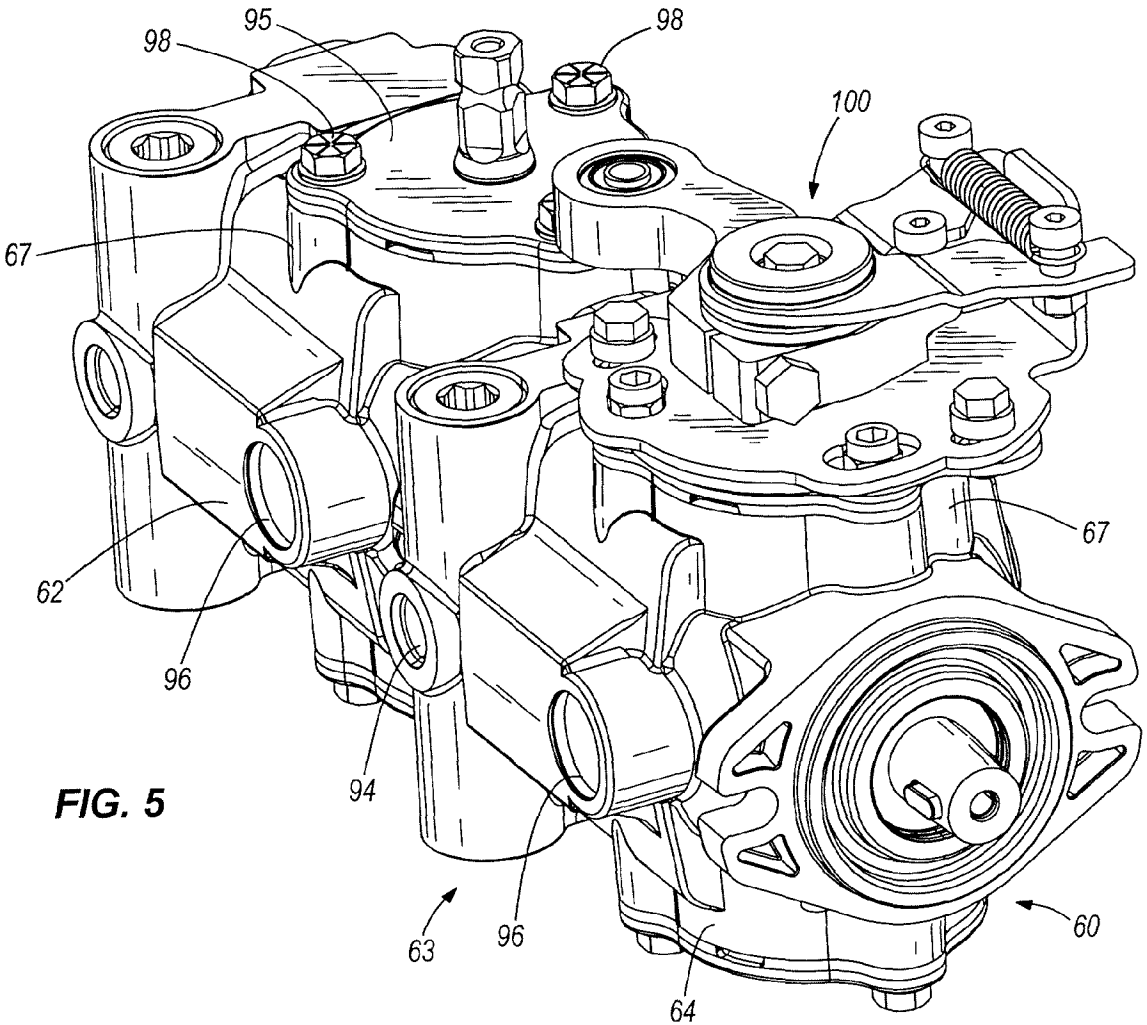
FIG. 5 is another perspective view of the tandem hydraulic pump assembly of FIG. 4.

FIGS. 4 and 5 illustrate a hydraulic pump assembly 60 of the type described above with respect to FIG. 3. Hydraulic pump assembly 60 includes left drive pump 62 and right drive pump 64. A front side 61 of the hydraulic pump assembly 60 is shown in FIG. 4, and a back side 63 of the hydraulic pump assembly 60 is shown in FIG. 5. Each of the left drive pump 62 and right drive pump 64 has a housing 67 with a pair of ports 92 therein, which are configured to be coupled via hydraulic links 70 and 72 to hydraulic motors 66A and 66B, respectively, as is shown in FIG. 3. Hydraulic oil is pumped under pressure through ports 92 from each of the left drive pump 62 and the right drive pump 64 to their respective hydraulic motors 66A and 66B. The direction of the hydraulic flow from the ports 92 depends on whether the respective drive pump has been actuated in a forward or reverse direction.

On the back side 63 of the hydraulic drive pump system 60, a port 94 is shown between the left drive pump 62 and the right drive pump 64. Port 94 is an inlet, which is configured to be coupled to a hydraulic oil supply (not shown). The hydraulic oil supply provides oil to each of the left drive pump 62 and the right drive pump 64. In addition, a pair of ports 96 is shown. Each of the ports 96 are adapted to be coupled to a hydraulic reservoir (not shown) to return oil from the respective hydraulic drive pumps to the reservoir.

Left drive pump 62 has a pintle arm or input shaft 88 that extends through a trunnion cap 95 that is fastened to the housing 67 of the left drive pump 62. Input shaft 88 engages an internal mechanism such as a swash plate (not shown) located inside the housing 67. The input shaft 88 is rotatable to cause the internal mechanism to move and direct oil within the left drive pump 62. Input shaft 88 has a centered or neutral position. In the neutral position, the swash plate is positioned so that no oil is pumped out of the ports 92, and thus, the wheels 12A and 12B are not driven by the left drive pump 62. In one illustrative embodiment, rotating the input shaft 88 in a clockwise direction will cause the internal mechanism to move and direct oil through the ports 92 to hydraulic motor 66A to cause wheels 12A and 12B to move in a forward direction. Rotating the input shaft 88 in a counter-clockwise direction will cause the wheels 12A and 12B to move in a reverse direction.

Figure 10:
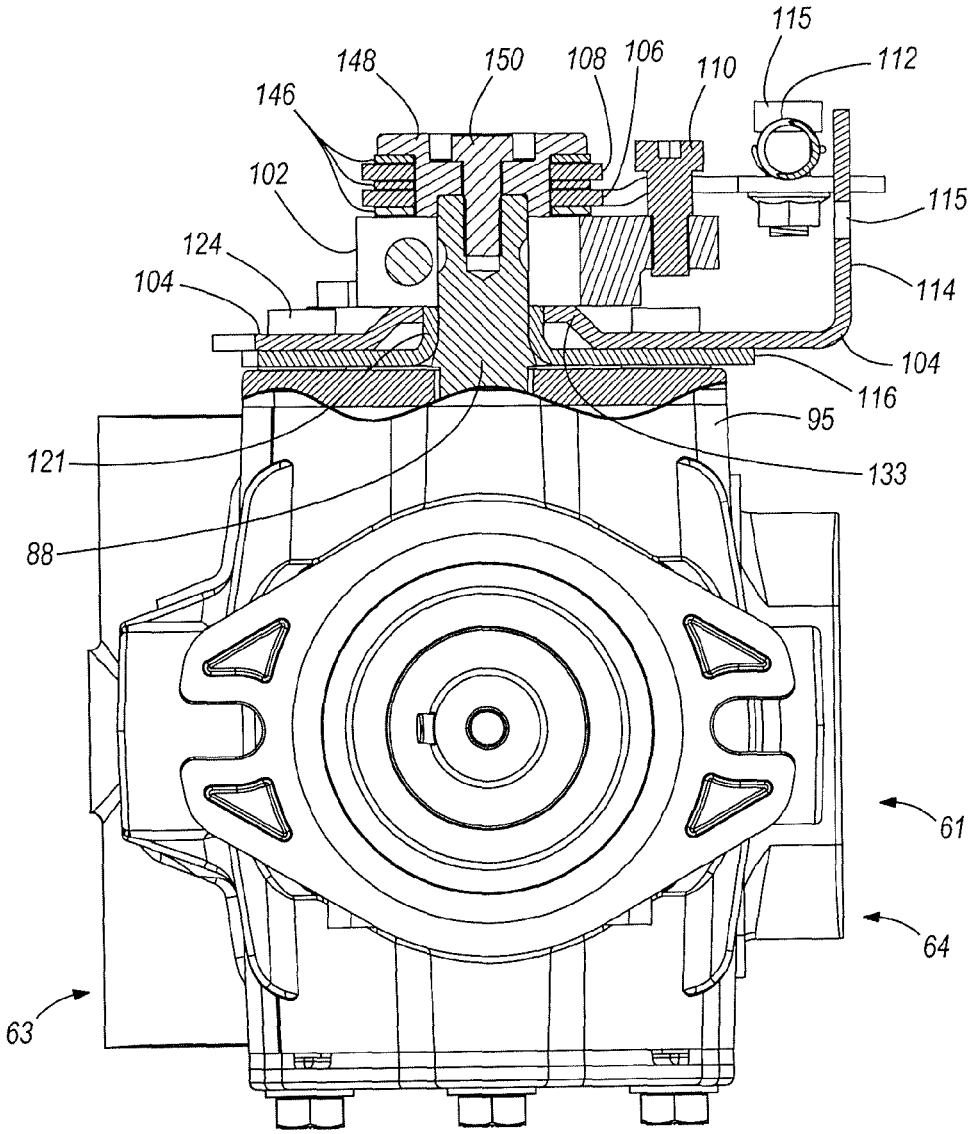
FIG. 10 is a cross-sectional view of the right drive pump of the tandem hydraulic pump assembly of FIG. 4 taken along a centerline axis of the input shaft and illustrating the positioning of the centering mechanism and control arm relative to the input shaft of the right drive pump.

Right drive pump 64 is similarly configured with an input shaft 88 (FIG. 10) that extends through a trunnion cap 95 and is coupled to an internal mechanism such as a swash plate (not shown). Right drive pump 64 is shown in FIGS. 4 and 5 with a pintle lever or control arm 102 attached to the input shaft 88. Control arm 102 is also adapted to be coupled to link 22 (FIG. 3). Control arm 102 thus transfers an operating force transmitted from the drive control actuator 58 through link 22 to the input shaft 88 to cause the input shaft 88 to rotate when such a force is applied.

A centering mechanism 100 is attached to the right drive pump 64. Centering mechanism 100 engages the control arm 102 to provide a centering force to assist the control arm 102 to move the input shaft 88 to the neutral position when no operating force is applied to the control arm 102 from the drive control actuator 58. It is to be understood that a control arm 102 and centering mechanism 100 of the type attached to the right drive pump 64 is also to be attached to the left drive pump 62. The hydraulic pump assembly 60 is shown in FIGS. 4 and 5 with just one centering mechanism 100 for illustrative purposes only.

Each centering mechanism 100 includes a first bracket 116. The first bracket 116 is adapted to be fixedly attached to the trunnion cap 95. Each of the left drive pump 62 and the right drive pump 64 have a trunnion cap 95, and thus a first bracket 116 is attached to each trunnion cap 95. Fasteners 98, which are engaged with the pump housing 67 to secure the trunnion cap 95 to the pump housing 67, are removed, and first bracket 116 is positioned upon the trunnion cap 95. Both the trunnion cap 95 and the first bracket 116 are then secured to the housing 67 by a plurality of fixing fasteners 124 that extend through apertures 122 in the first bracket 116 as well as through the trunnion cap 95.

A second bracket 104 is mounted onto the first bracket 116. Second bracket 104 is rotatably adjustable with respect to the first bracket 116. Second bracket 104 includes a generally planar body or primary portion 105 and a tab 114, which extends angularly away from the generally planar primary portion 105. Primary portion 105 is aligned so that when the second bracket 104 is mounted onto the first bracket 116, the primary portion 105 is positioned adjacent to the first bracket 116, and the tab 114 extends away from the first bracket 116. Second bracket 104 has a pair of slots 130 that extend through the primary portion 105 and though each of which an adjusting fastener 132 extends to engage the first bracket 116 to secure the second bracket 104 to the first bracket 116. The slots 130 allow for some adjustment of the second bracket 104 with respect to the first bracket 116 when the fasteners 132 are not firmly in place. When the fasteners 132 are firmly in place, the second bracket 104 is securely fastened to the first bracket 116.

Control arm 102 is configured to be positioned adjacent to the second bracket 104 and be secured to the input shaft 88. First centering arm 106 and second centering arm 108 are positioned adjacent the control arm 102. A bushing 148, which is fastened by a fastener 150 to the input shaft 88, captures the first and second centering arms 106 and 108 between the bushing 148 and the control arm 102. The bushing 148 also provides a rotating fulcrum for the first and second centering arms 106 and 108 so that they are rotatable with respect to the input shaft 88.

Each of the first centering arm 106 and the second centering arm 108 extend away from the input shaft 88 and are positioned so that they are on opposite sides of tab 114. A coil spring 112 is attached to each of the first centering arm 106 and the second centering arm 108. The coil spring 112 exerts a force on each of the first centering arm 106 and the second centering arm 108 that tends to pull the two centering arms 106 and 108 together. When no other force is acting upon the first centering arm 106 and the second centering arm 108, they are pulled together until each of the centering arms 106 and 108 engages tab 114.

A fastener 110 extends into the control arm 102 so that it is positioned between and is capable of engaging the first and second centering arms 106 and 108. When the control arm 102 moves from the neutral or centered position, for example, towards the front side 61 of hydraulic pump assembly 60, the fastener 110 rotates with the control arm 102 in a clockwise direction and engages centering arm 108. The force applied by the coil spring 112 against centering arm 108 is overcome and the centering arm 108 is rotated away from the tab 114 along with the control arm 102. When forces, such as the actuation of the drive control actuator 58 that can act on the control arm 102, are removed, the coil spring 112 urges the second centering arm 108 toward the first centering arm 106 until the second centering arm 108 engages tab 114.

When tab 114 is properly positioned and the first centering arm 106 and the second centering arm 108 are positioned to engage the tab 114, the centering arms 106 and 108 urge the control arm 102 to move the input shaft 88 into the neutral position. Adjustment of the second bracket 104 with respect to the first bracket 116, therefore, rotates tab 114, which defines the position of the input shaft 88 when no other force is acting upon the control arm 102. Thus, if the tab 114 is properly adjusted, the input shaft 88 will return to the neutral position when no other force is acting upon the control arm 102. As described above, the second bracket 104 can be adjusted with respect to the first bracket 116 to position the tab 114 so that it is properly positioned.

Figure 6:
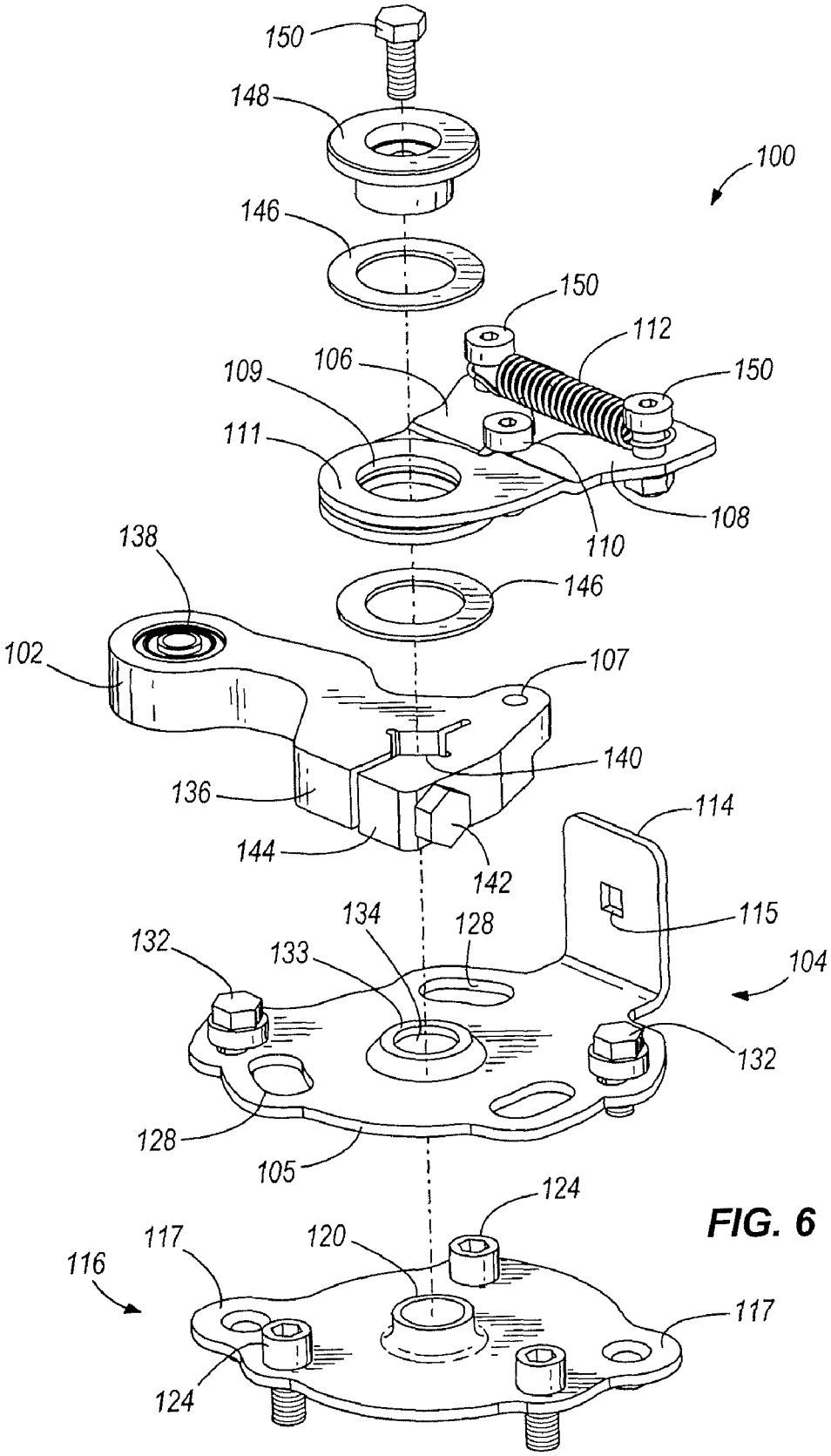
FIG. 6 an exploded diagram illustrating the centering mechanism of FIG. 4.
Figure 7A:
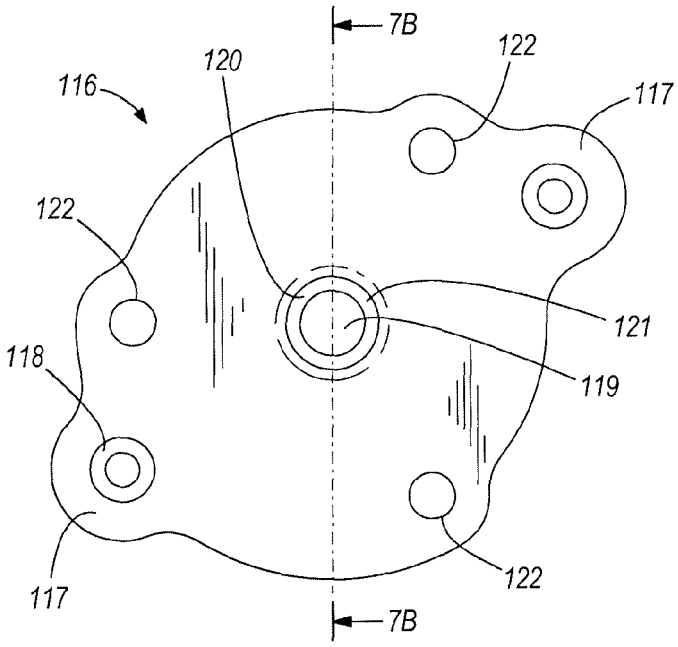
FIG. 7A is a plan view of an illustrative embodiment of a first bracket of the centering mechanism of FIG. 6.
Figure 7B:
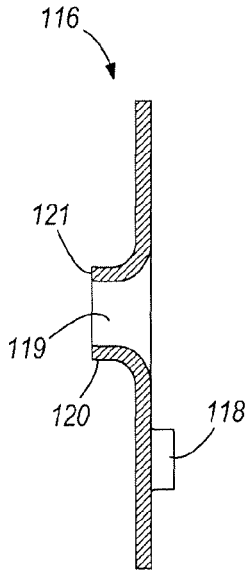
FIG. 7B is a cross-sectional view of the first bracket of FIG. 7A taken along line 7B-7B.
Figure 7C:
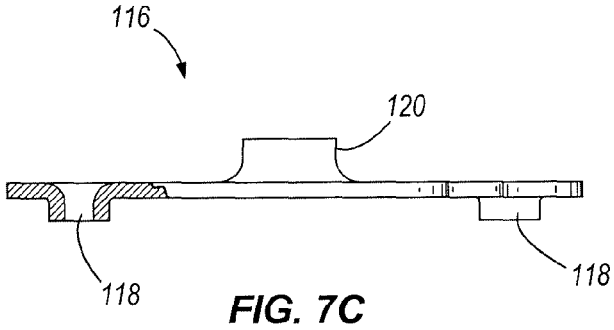
FIG. 7C is a side elevational view of the first bracket of FIG. 7A with a cross-sectional view of a feature configured to accept a threaded fastener.

FIG. 6 is an exploded view of centering mechanism 100 and control arm 102. First bracket 116 (also shown in FIGS. 7A-7C) has a plurality of apertures 122, which are positioned to be aligned with similar apertures in the trunnion cap 95 so that fasteners 124 can extend through the first bracket 116 and the trunnion cap 95 to secure both components to the housing 67. First bracket 116 includes a pair of flanges 117, which are positioned to extend beyond the outer perimeter of trunnion cap 95. A boss 118 extends into each of the flanges 117. Each boss 118 is adapted to accept a threaded fastener 132 to secure the second bracket 104 to the first bracket 116. In one illustrative embodiment, boss 118 is extruded into the first bracket 118 and is provided with a thread to accept threaded fastener 132. However, the boss 118 can be formed in any manner and need not be provided with threads.

First bracket 116 also includes a formation 120 with an aperture 119 extending therethrough to allow the first bracket 116 to be fitted over the input shaft 88. The aperture 119 is large enough so that the first bracket 116 does not engage the input shaft 88. The formation 120 includes a lip 121, which is shaped to engage the second bracket 104 so that the second bracket 104 can be positioned properly with respect to the first bracket 116 and the input shaft 88.

Figure 8A:
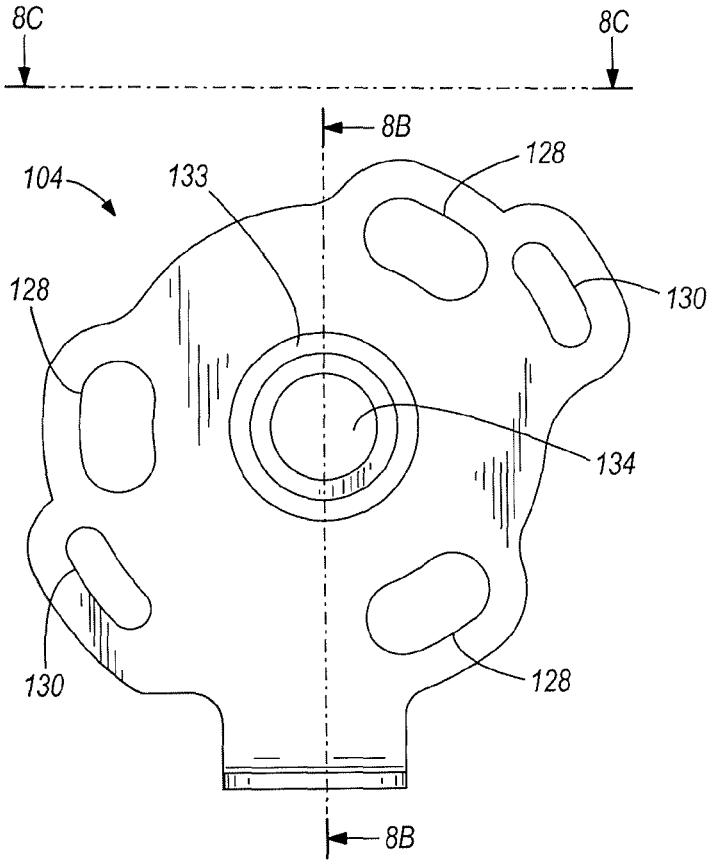
FIG. 8A is a plan view of the second bracket of the centering mechanism of FIG. 6, which is configured to engage the first bracket.
Figure 8B:
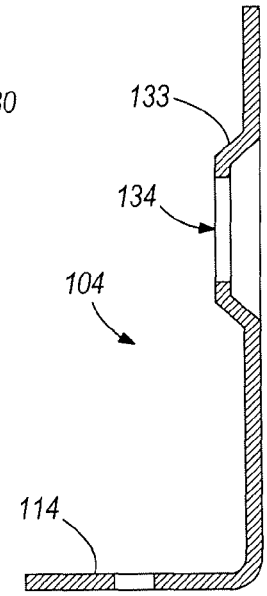
FIG. 8B is a cross-sectional view of the second bracket of FIG. 8A taken along line 8B-8B.
Figure 8C:
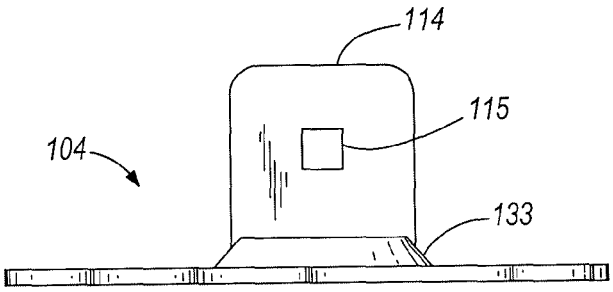
FIG. 8C is a side elevational view of the second bracket of FIG. 8A viewed from line 8C-8C.

The second bracket 104 (also shown in FIGS. 8A-8C) is configured to be positioned adjacent and be attached to the first bracket 116. Second bracket 104 includes a protrusion 133 formed into the generally planar primary portion 105 of the second bracket 104. Protrusion 133 can be extruded into the second bracket 104 and includes an aperture 134 that is sized so that the protrusion 133 fits over the feature 120 and engages the lip 121 on the first bracket 116. The second bracket 104 is thus centered on the first bracket 116 and is capable of rotating on the feature 120. The relationship between the lip 121 and the protrusion 133 (shown in FIG. 10) centers the second bracket 104 relative to the first bracket 116 and the input shaft 88, thereby preventing the second bracket 104 from moving off center when it is being adjusted.

The second bracket 104 further includes a plurality of slotted apertures 128. The slotted apertures 128 are positioned to fit over the fasteners 124, which hold the first bracket 116 to the housing 67. This allows the second bracket 104 to be able to rotate with respect to the first bracket 116 without any interference from the fasteners 124.

Second bracket 104 further includes a pair of slots 130 each of which are sized to accept a fastener 132. Fasteners 132 are also configured to engage threaded boss 118 in the first bracket 116 to secure the second bracket 104 to the first bracket 116. When the fasteners 132 are not snuggly fitted onto the second bracket 104, the second bracket 104 is capable of rotating with respect to the first bracket 116 within the confines of slots 130 to properly position tab 114. When the fasteners 132 are snuggly tightened, the second bracket 104 is firmly held in position with respect to the first bracket 116.

Tab 114 includes an aperture 115 extending therethrough. Aperture 115 is configured to accept a tool such as a screwdriver or other similar instrument. By inserting an instrument into the aperture 115 when the fasteners 132 are not snugly tightened to the second bracket 104, the second bracket 104 can be easily rotated in one direction or the other to find a proper position for the tab 114.

Figure 9A:
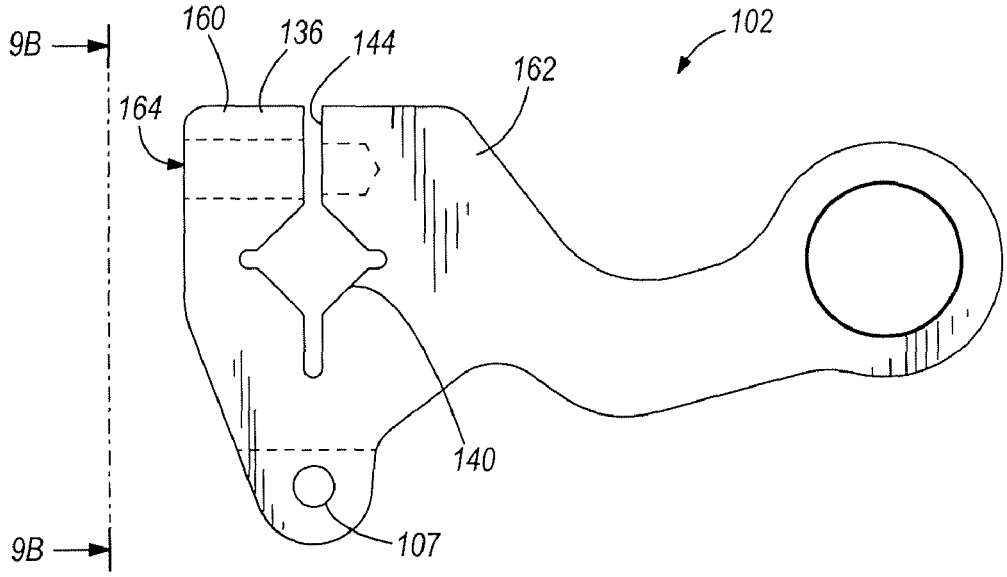
FIG. 9A is a plan view of a control arm that is configured to engage the input shaft of the hydraulic pump of FIG. 4.
Figure 9B:
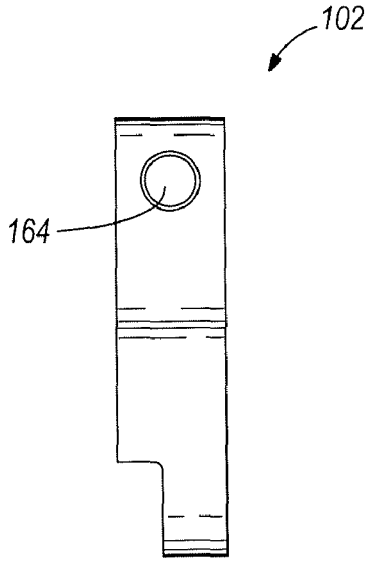
FIG. 9B is a side elevation view of the control arm of FIG. 9A viewed from line 9B-9B, illustrating an aperture configured to accept a threaded fastener.

Control arm 102 (also illustrated in FIGS. 9A-9B) is positioned adjacent the second bracket 104. Control arm 102 includes an aperture 140 that is sized and shaped to accept and be engaged with the input shaft 88. Control arm 102 also includes a slot 144 that extends from aperture 140 to an outer surface 136 of the control aim 102. Slot 144 divides a portion of the control arm 102 into first and second fingers 160 and 162, respectively. A cross bore 164 extends through first finger 160 and into second finger 162. Cross bore 164 is configured to accept a fastener 142. Fastener 142 is capable of engaging the cross bore 164 so that it is fixedly attached to the control arm 102. When fastener 142 is engaged with control arm 102, tightening the fastener 142 causes the control arm 102 to deform slightly at the slot 144 to snuggly fit the control arm 102 onto the input shaft 88. Control arm 102 also includes a linkage engagement member 138, which is configured to accept and be attached to link 22.

Control arm 102 is thus rotatable with respect to the first and second brackets 116 and 104. When a force from the drive control actuator 58 is transmitted via link 22 to the control arm 102, the control arm 102 rotates towards the forward direction 61 or the reverse direction 63. The control arm 102 thus rotates the input shaft 88 with respect to the casting 67, causing the internal mechanism to move and direct oil to the particular hydraulic motor through the orifices 92.

First and second centering arms 106 and 108 are positioned adjacent the control arm 102. Each of the first and second centering arms 106 and 108 has an aperture 109 extending through a first end 111 of the respective arms. The aperture 109 in each of the first and second centering arms 106 and 108 is large enough to fit over the input shaft 88 without engaging the input shaft 88. Bushing 148 provides a retaining force onto the first and second centering arms 106 and 108 to hold the centering arms 106 and 108 in position with respect to the control arm 102. Spacers 146 are positioned between the control arm 102 and the first centering arm 106 as well as between the first centering arm 106 and the second centering arm 108. Another spacer 146 is positioned between the second centering arm 108 and the bushing 148. Spacers 146 prevent metal-to-metal contact between the control arm 102, first and second centering arms 106 and 108 and bushing 148.

Returning again to FIG. 6, each of the first and second centering arms 106 and 108 has a member 150 on a second end of the centering arm 106 and 108 adapted to accept and secure coil spring 112. Spring 112 is positioned between the first and second centering arms 106 and 108 and acts to pull the first and second centering arms 106 and 108 toward each other. A fastener 110 is fitted into the control arm 102 at an aperture 107. The fastener 110 is positioned so that it is capable of engaging either the first centering arm 106 or the second centering arm 108 when the control arm 102 rotates with respect to the first and second brackets 116 and 104. Thus, the fastener 110, which moves with the control arm 102 acts against the spring 112 to separate the first centering arm 106 from the second centering arm 108.

When a force from the drive control actuator 58 is removed, the spring 112 tends to pull the first centering arm 106 and the second centering arm 108 together until they are both engaging the tab 114 of the second bracket 104. It is to be understood that depending on the direction of rotation of control arm 102, fastener 110 will engage either the first centering arm 106 or the second centering arm 108.

Figure 11A:
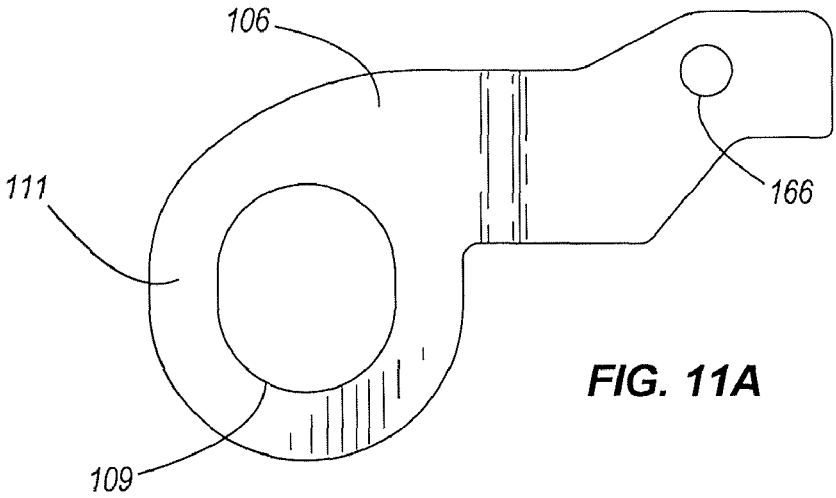
FIG. 11A is a plan view of a centering arm of the centering mechanism of FIG. 6.
Figure 11B:
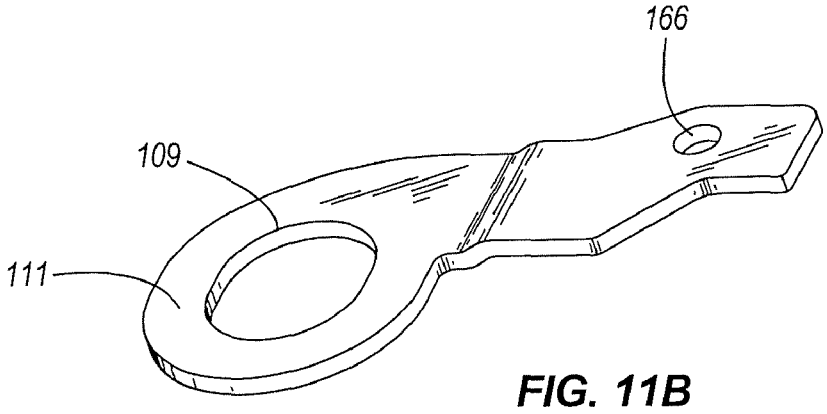
FIG. 11B is a perspective view of the centering arm of FIG. 11A.
Figure 11C:
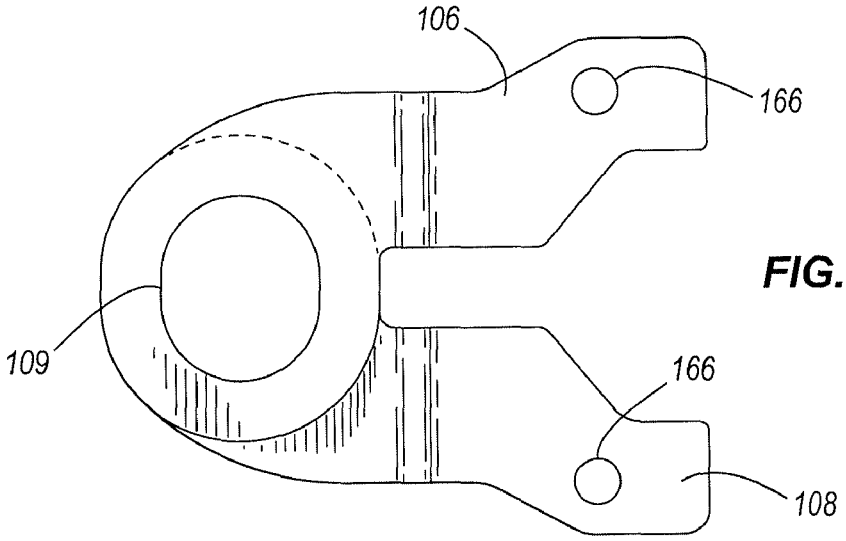
FIG. 11C illustrates a pair of centering arms positioned adjacent one another as in the centering mechanism of FIG. 6.
Figure 12:
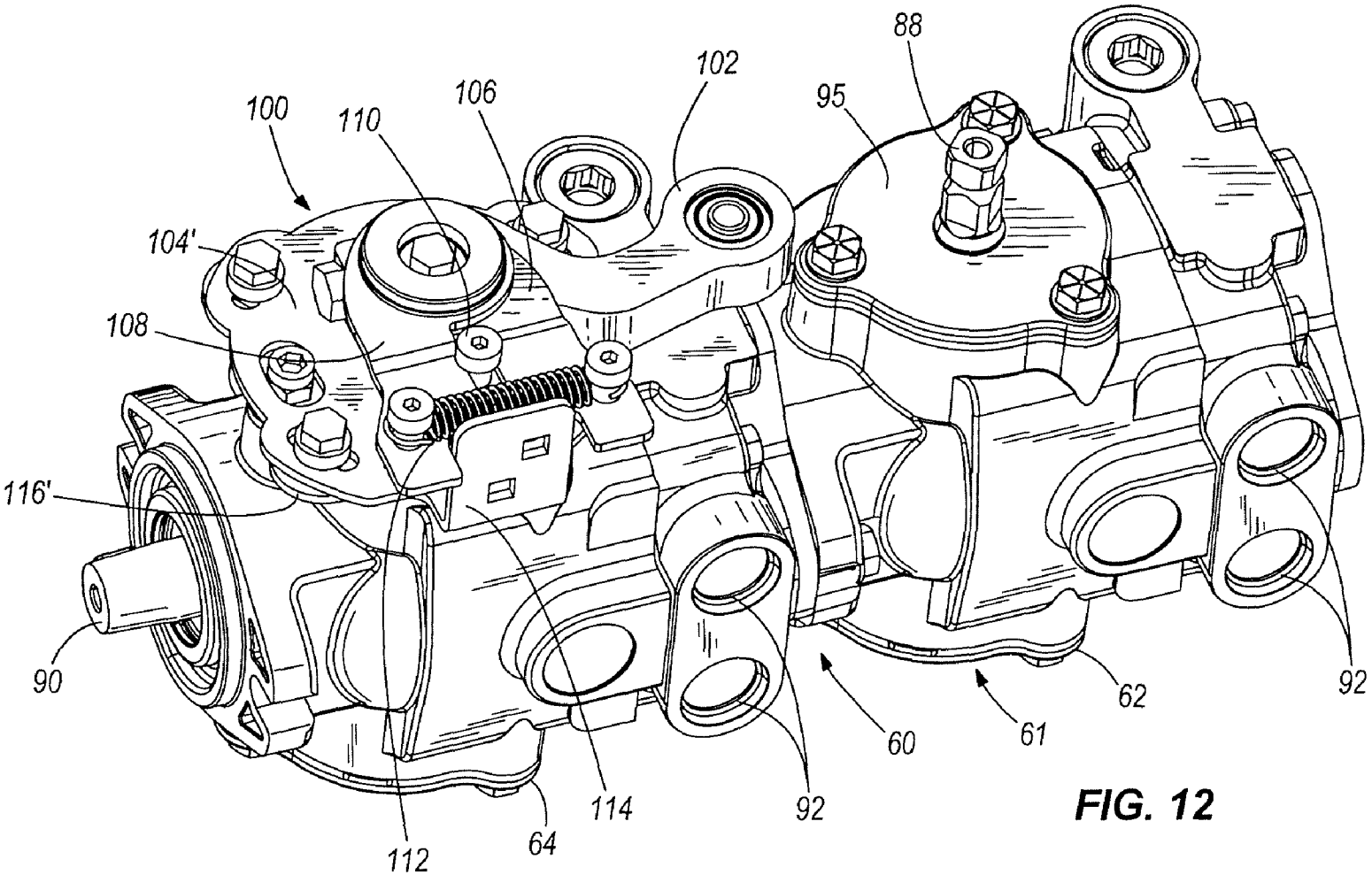
FIG. 12 is a perspective view of a tandem hydraulic pump assembly illustrating a centering mechanism of an alternative illustrative embodiment coupled to an input shaft of one of the hydraulic pumps.
Figure 13:
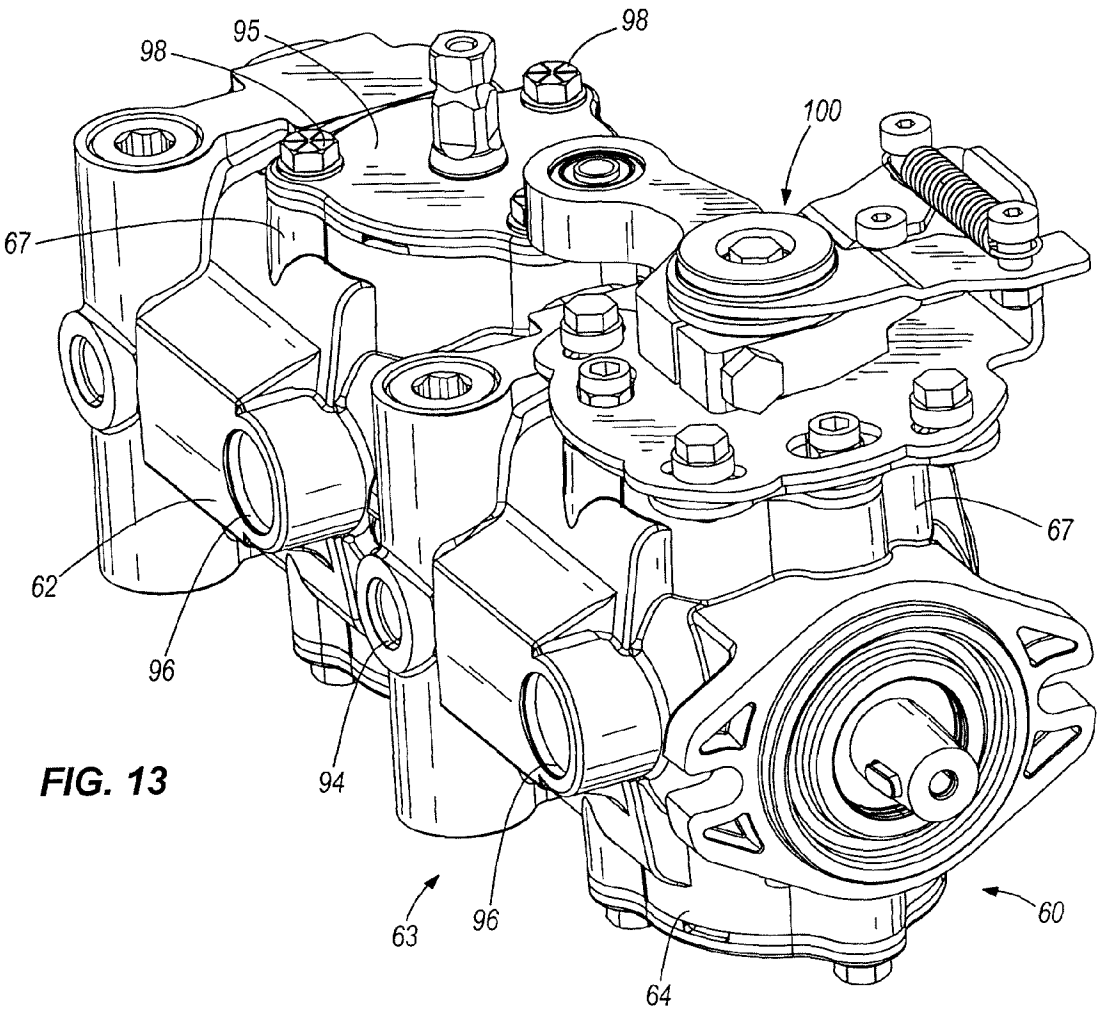
FIG. 13 is another perspective view of the tandem hydraulic pump assembly of FIG. 12.

FIGS. 11A-11C illustrate the first and second centering arms 106 and 108 in more detail. In the illustrative embodiment, the first centering arm 106 and the second centering arm 108 are identical or nearly identical. The first and second centering arms 106 and 108 include an aperture 166 on a second end that is capable of accepting member 150 to provide an attachment point on each of the first and second centering arms 106 and 108 for coil spring 112. As shown in FIG. 6, member 150 can be a fastener system, such as a nut and bolt arrangement, that is attached at the aperture 166. The first and second centering arms 106 and 108 are shown aligned together in FIG. 11C.

FIGS. 12-16 illustrate an alternative illustrative embodiment of a portion of the centering mechanism 100. In FIGS. 12-16, the pump assembly 60 and the centering mechanism 100 are similar to that described above with respect to FIGS. 1-11C. Common elements have the same reference number, and modified elements have the same reference number“'”.

Figure 14:
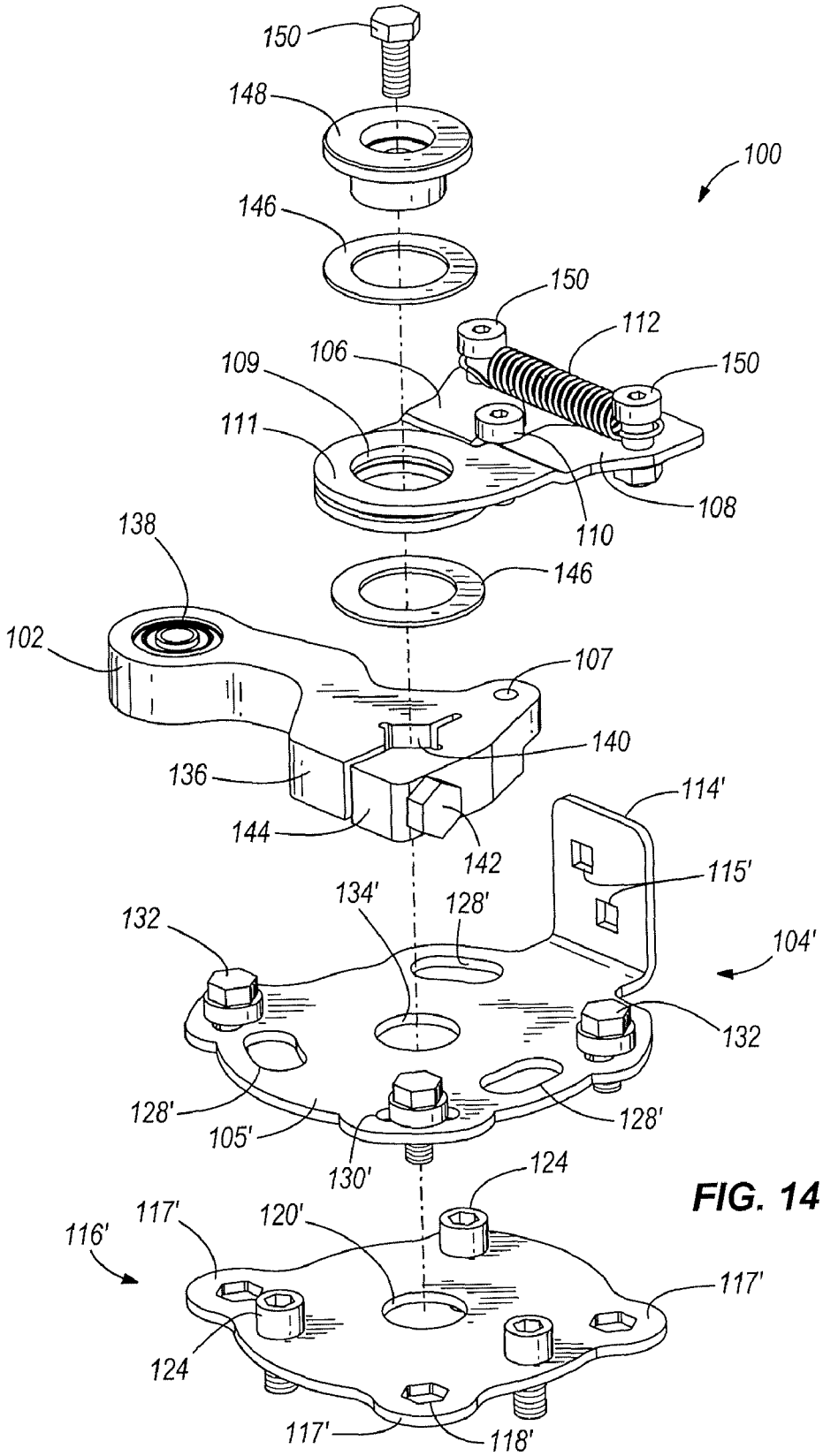
FIG. 14 an exploded diagram illustrating the centering mechanism of FIG. 12.
Figure 15:
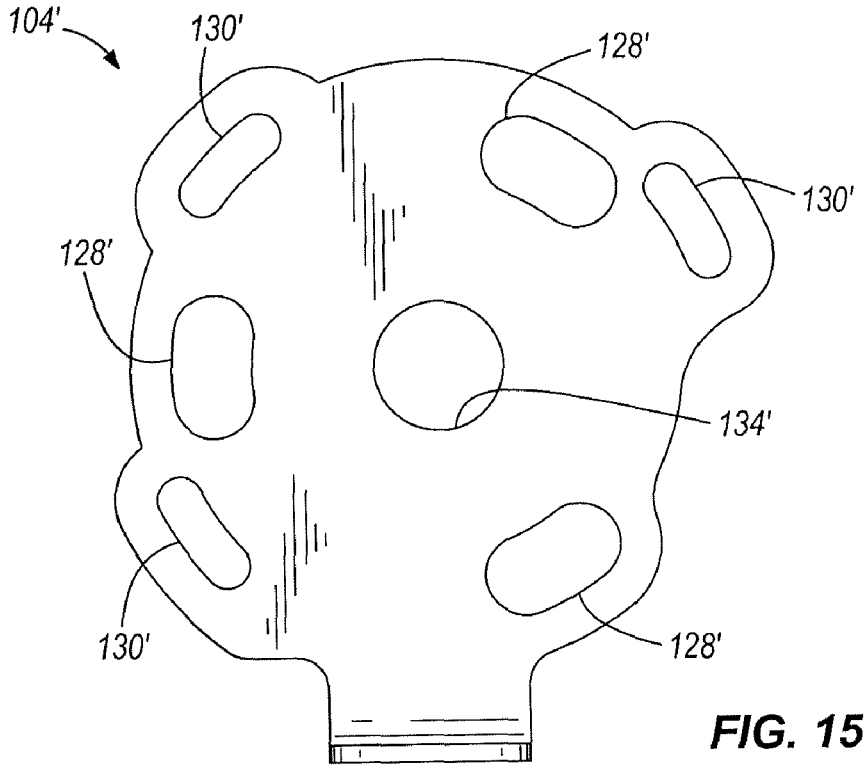
FIG. 15 is a plan view of an alternative illustrative embodiment of a second bracket of the centering mechanism of FIG. 14.
Figure 16:
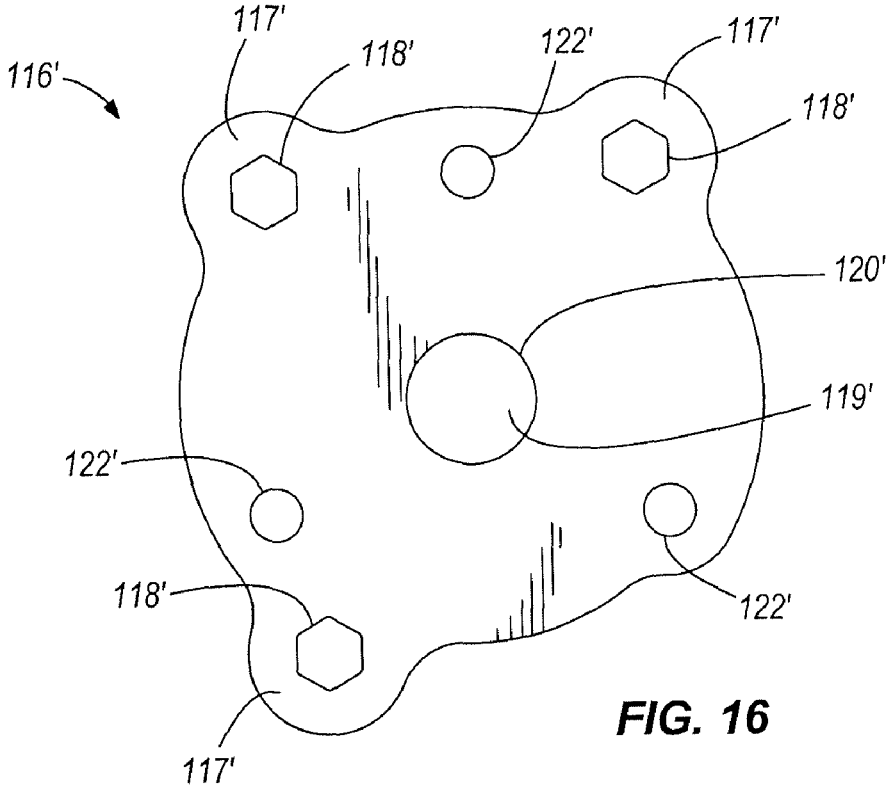
FIG. 16 is a plan view of an alternative illustrative embodiment of a first bracket of the centering mechanism of FIG. 14.

FIG. 15 illustrates an alternative construction of the second bracket 104', and FIG. 16 illustrates an alternative construction of the first bracket 116'. In the alternative construction, the second bracket 104' defines three adjusting slots 130', and the first bracket 116' correspondingly defines three bosses 118'. As shown in FIG. 14, three adjusting fasteners 132' are provided to adjustably connect the second bracket 104' to the first bracket 116'.

In the illustrated alternative embodiment, the tab 114' of the second bracket 104' defines a pair of apertures 115'. A tool (or more than one tool) may engage one or both of the apertures 115' and be used to adjust the second bracket 104' relative to the first bracket 116'.

In the illustrated alternative embodiment, the bosses 118' defined in the first bracket 116' do not depend below the lower surface of the first bracket 116'. Also, in the illustrated alternative embodiment, the second bracket 104' and the first bracket 116' are not provided with the cooperating protrusion 133 and lip 121, described above. It should be understood, however, that such structure may be provided for this alternative embodiment. With these modifications, the first bracket 116' and the second bracket 104' (with the exception of the tab 114') are substantially planar.

The illustrative embodiments provide for a centering system on a hydraulic drive pump that is easy to adjust. Merely by temporarily loosening fasteners 132 and engaging aperture 115 to move or rotate the second bracket 104 with respect to the first bracket 116, the centering mechanism 100 can be easily adjusted so that that it is properly positioned. Thus, when there is no force applied on the control arm 102 by the operator through drive control actuators 58, the centering mechanism 100 will urge the input shaft 88 to a neutral position. The arrangement allows for an easily adjustable centering mechanism that is amenable to small adjustments.

Although the present disclosure has been described with reference to the preferred embodiments, workers skilled in the art will recognize that changes may be made in form and detail without departing from the spirit and scope of the disclosure.

We claim:

1. A centering mechanism for a hydraulic pump, the pump including a pump housing and an input shaft extending along an axis, the pump having a neutral condition in which hydraulic fluid does not flow through the pump, a control arm being connected to the shaft, movement of the control arm controlling operation of the pump, the centering mechanism comprising:

a bracket assembly including a first bracket fixable to the housing and defining threaded holes, a second bracket adjustably fixable to the first bracket member, the second bracket defining slots associated and partially alignable with the threaded holes, and adjusting fasteners, each adjusting fastener extending through an associated slot and threadable in an associated threaded hole to adjustably fix the second bracket to the first bracket; and biasing structure operable to return the control arm to a centered position when an operating force is not applied to the control arm;

wherein the second bracket is adjustable relative to the first bracket such that the centered position corresponds to the neutral condition of the pump, the second bracket being fixable in the position by the adjusting fasteners.

2. The centering mechanism of claim 1, wherein the second bracket defines two slots, the slots being positioned substantially on opposite radial sides of the axis, wherein the first bracket defines two threaded holes, the threaded holes being positioned substantially on opposite radial sides of the axis in positions corresponding to the respective slots, and wherein the centering mechanism includes two adjusting fasteners.

3. The centering mechanism of claim 1, wherein the second bracket includes a tab, and wherein the biasing structure includes a centering arm assembly engageable with the control arm, and a spring connected to the centering arm assembly and applying a force biasing the centering arm assembly toward the tab to return the control arm to the centered position.

4. The centering mechanism of claim 3, wherein the centering arm assembly includes a first centering arm engageable with a first side of the control arm, the first centering arm operating to return the control arm to the centered position in a first direction, and a second centering arm engageable with an opposite second side of the control aπn, the second centering arm operating to return the control arm to the centered position in an opposite second direction.

5. The centering mechanism of claim 4, wherein the spring is connected between the first centering arm and the second centering arm.

6. The centering mechanism of claim 4, wherein the second bracket includes a radially-extending body, the tab extending axially from the body and being positioned between the first centering arm and the second centering arm.

7. The centering mechanism of claim 1, wherein the first bracket defines a first opening, the shaft being extendable therethrough, an axially-directed lip extending at least partially about the opening, and wherein the second bracket defines a second opening, the shaft being extendable therethrough, the second opening engaging the lip to limit radial movement of the second bracket relative to the first bracket.

8. The centering mechanism of claim 7, wherein the second bracket includes an axially-directed protrusion extending at least partially about the second opening, the protrusion cooperating with the lip to limit radial movement of the second bracket relative to the first bracket.

9. The centering mechanism of claim 1, wherein the second bracket defines an adjustment aperture for receiving a tool to facilitate adjustment of the second bracket relative to the first bracket.

10. A hydraulic pump assembly comprising:

a hydraulic pump including a pump housing, a pump mechanism operable to control a flow of hydraulic fluid through the housing, the pump mechanism having a neutral condition in which fluid does not flow through the housing, a trunnion cap connectable to the housing, the trunnion cap and the housing cooperating to house the pump mechanism, and an input shaft extending along an axis and through the trunnion cap, the shaft being rotatable to operate the pump mechanism;

a control arm connected to the shaft, movement of the control arm causing rotation of the shaft; and a centering mechanism including a first bracket fixable to the housing, a second bracket adjustably fixable to the first bracket, and biasing structure operable to return the control arm to a centered position when an operating force is not applied to the control arm, the second bracket being adjustable relative to the first bracket to an adjusted position such that the centered position corresponds to the neutral condition of the pump mechanism, the second bracket being fixable in the adjusted position; and fasteners fixing the first bracket and the trunnion cap to the pump housing.

11. The pump assembly of claim 10, wherein the second bracket defines slotted apertures, and wherein each fastener at least partially extends into an associated slotted aperture to avoid impeding adjustment of the second bracket relative to the first bracket.

12. The pump assembly of claim 11, wherein the pump assembly includes three fasteners fixing the first bracket and the trunnion cap to the pump housing, the fasteners being substantially evenly spaced about the axis, and wherein the second bracket defines three slotted apertures, the slotted apertures being spaced substantially evenly about the axis in positions corresponding to the respective fasteners.

13. The pump assembly of claim 10, wherein the second bracket defines slots, wherein the first bracket defines associated threaded holes, and wherein the centering mechanism further includes adjusting fasteners, each adjusting fastener extending through the associated slot and being threadable in the associated threaded hole to adjustably fix the second bracket to the first bracket.

14. The pump assembly of claim 13, wherein the second bracket defines two slots, the slots being positioned substantially on opposite radial sides of the axis, wherein the first bracket defines two threaded holes, the threaded holes being positioned substantially on opposite radial sides of the axis in positions corresponding to the respective slots, and wherein the centering mechanism includes two adjusting fasteners.

15. The pump assembly of claim 13, wherein the first-mentioned fasteners define a radial periphery, wherein the first bracket has a radial first flange, the threaded holes being defined in the first flange beyond the radial periphery, and wherein the second bracket has a radial second flange, the slots being defined on the second flange beyond the radial periphery.

16. The pump assembly of claim 10, wherein the second bracket includes a tab, and wherein the biasing structure includes a centering arm assembly engageable with the control arm, and a spring connected to the centering arm assembly and applying a force biasing the centering arm assembly toward the tab to return the control arm to the position.

17. The pump assembly of claim 16, wherein the centering arm assembly includes a first centering arm engageable with a first side of the control arm, the first centering arm operating to return the control arm to the position in a first direction, and a second centering arm engageable with an opposite second side of the control arm, the second centering arm operating to return the control arm to the position in an opposite second direction.

18. The pump assembly of claim 17, wherein the spring is connected between the first centering arm and the second centering arm.

19. A method of assembling a hydraulic pump assembly, the pump assembly including a hydraulic pump, the pump including a pump housing, a pump mechanism operable to control a flow of hydraulic fluid through the housing, the pump mechanism having a neutral condition in which fluid does not flow through the housing, a trunnion cap, and an input shaft extending along an axis, the shaft being rotatable to operate the pump mechanism, the pump assembly also including a control arm, movement of the control arm causing rotation of the shaft, and a centering mechanism, the centering mechanism including a first bracket, a second bracket, and biasing structure operable to return the control arm to a centered position when an operating force is not applied to the control arm, the method comprising the acts of:

positioning the pump mechanism at least partially in the housing;

positioning the trunnion cap on the housing to substantially enclose the pump mechanism;

providing fixing fasteners;

with the fixing fasteners, fixing the first bracket and the trunnion cap to the housing, the shaft extending through the trunnion cap;

providing adjusting fasteners;

with the adjusting fasteners, connecting the first bracket and the second bracket;

connecting the control arm to the shaft;

loosening the adjusting fasteners to unfix the second bracket from the first bracket;

moving the second bracket relative to the first bracket to an adjusted position such that the centered position corresponds to the neutral condition of the pump; and tightening the adjusting fasteners to thereby fix the second bracket to the first bracket in the adjusted position.

20. The method of claim 19, wherein the first bracket defines a first opening, the shaft being extendable therethrough, an axially-directed Hp extending at least partially about the opening, wherein the second bracket defines a second opening, an axially-directed protrusion extending at least partially about the second opening, wherein the moving act includes the act of limiting radial movement of the second bracket relative to the first bracket through engagement of the protrusion and the lip.

* * * * *